US008235542B2

(12) United States Patent
Yohananoff

(10) Patent No.: US 8,235,542 B2
(45) Date of Patent: Aug. 7, 2012

(54) ILLUMINATION DEVICE FOR PAVED FLOOR

(75) Inventor: Binyamin Yohananoff, Tel Aviv (IL)

(73) Assignee: Ubox Ltd. (IL)

( * ) Notice: Subject to any disclaimer, the term of this patent is extended or adjusted under 35 U.S.C. 154(b) by 413 days.

(21) Appl. No.: 12/644,216

(22) Filed: Dec. 22, 2009

(65) Prior Publication Data

US 2010/0188842 A1 Jul. 29, 2010

(30) Foreign Application Priority Data

Jan. 28, 2009 (IL) ..... 196771

(51) Int. Cl.
*F21S 8/02* (2006.01)

(52) U.S. Cl. ..... 362/153.1; 362/153; 362/365; 362/375

(58) Field of Classification Search ..... 362/146–147, 362/153, 153.1, 364, 365, 368, 369, 375; 52/747.11, 306, 390–392; 345/1.3
See application file for complete search history.

(56) References Cited

U.S. PATENT DOCUMENTS

| | | | | |
|---|---|---|---|---|
| 4,332,005 | A * | 5/1982 | McCall | 362/150 |
| 7,108,394 | B1 * | 9/2006 | Swarens et al. | 362/147 |
| 8,021,014 | B2 * | 9/2011 | Jacobsson | 362/153 |
| 8,092,034 | B2 * | 1/2012 | Zarian et al. | 362/145 |
| 8,092,036 | B2 * | 1/2012 | Jacobsson | 362/153 |

* cited by examiner

*Primary Examiner* — Thomas Sember
(74) *Attorney, Agent, or Firm* — Cantor Colburn LLP

(57) ABSTRACT

An illumination device for illuminating a paved floor comprising a container, which comprises a box creating a cavity therein and a first frame, integrally connected to the upper rim of the box; an illumination set comprising at least one light source (e.g. LED), where the illumination set is installed inside the container, where at least one light source enables illumination of the illumination device; a cover, which is adapted to be seated within the first frame, where the cover enables light from the illumination set to be transferred therethrough; a second frame, enabling to hold the cover between the first and the second frame; and at least two fastening means enabling to fasten the second frame to the first frame to hold the cover therebetween. The illumination device may be configured to be installed in the paved floor as one of the floor's tiles.

23 Claims, 5 Drawing Sheets

ILLUMINATION DEVICE FOR PAVED FLOOR

CROSS REFERENCE TO RELATED APPLICATIONS

This U.S. patent application claims priority to IL Patent Application No. 196771 filed on Jan. 28, 2009, the content of which is incorporated herein by reference.

BACKGROUND

1. Field of the Invention

The present invention relates generally to the field of illumination systems and devices and more particularly to illumination devices for paved surfaces.

2. Discussion of Related Art

Illuminating an outdoor area such as a road part, a pavement part or an entrance area leading into a dwelling is usually carried out by installing illuminating devices such as lamps above floor level, where the aperture of light emission from the light source of the illuminating device is usually directed downwards, towards the floor.

Illuminating an advertisement window is also known, where a surface comprising the advertisement (usually paper adhered to a glass) is illuminated from the back or from the front side of the advertisement. This is often used in bus stations or advertisement posts where a light source illuminates a poster including the ad content, where the other side of the ad is adhered to a glass surface or other similar transparent materials such as transparent plastic surface (Perspex), etc. This technique helps people who pass by the ad to see its content at dark as well as highlighting the ad at day time.

The illuminated ad windows are usually situated in an apparatus holding the windows above floor level.

Outdoor floor walking surfaces such as pavements, are often constructed of tiles that pave the surface upon which people can walk. Installing the tiles is usually carried out by placing a feeling material such as concrete in a non-dry and non-harden state, straightening the material, placing the tiles upon the straightened material and then waiting for the material to dry and thereby adhere to the tiles.

Since most illuminated devices are situated above floor level, we usually do not expect for the floor or pavement we walk upon to illuminate, especially in the outdoor areas.

SUMMARY

The present invention, according to some embodiments thereof, provides an illumination device for illuminating a paved floor. The illumination device may comprise: a container, which comprises a box creating a cavity therein and a first frame, integrally connected to the upper rim of the box, wherein the first frame frames the upper rim of the box; an illumination set comprising at least one light source, wherein the illumination set is installed inside the container, wherein at least one light source enables illumination of the illumination device; a cover, which is adapted to be seated within the first frame, wherein the cover enables light from the illumination set to be transferred therethrough; a second frame, enabling to hold the cover between the first and the second frame; and at least two fastening means enabling to fasten the second frame to the first frame to hold the cover therebetween.

The at least one fastening means may comprise a first member and a second member adapted to be fastened to one another, wherein the first member is attached to the lower inner side of the first frame and the second member is removable enabling to fasten to the first member and to be removed therefrom, to allow removing and reinstalling the second frame and the cover to the container.

The illumination device may be configured to be installed in a paved floor as one of the floor's tiles.

BRIEF DESCRIPTION OF THE DRAWINGS

The subject matter regarded as the invention will become more clearly understood in light of the ensuing description of embodiments herein, given by way of example and for purposes of illustrative discussion of the present invention only, with reference to the accompanying drawings, wherein.

DESCRIPTION

Figure 1:
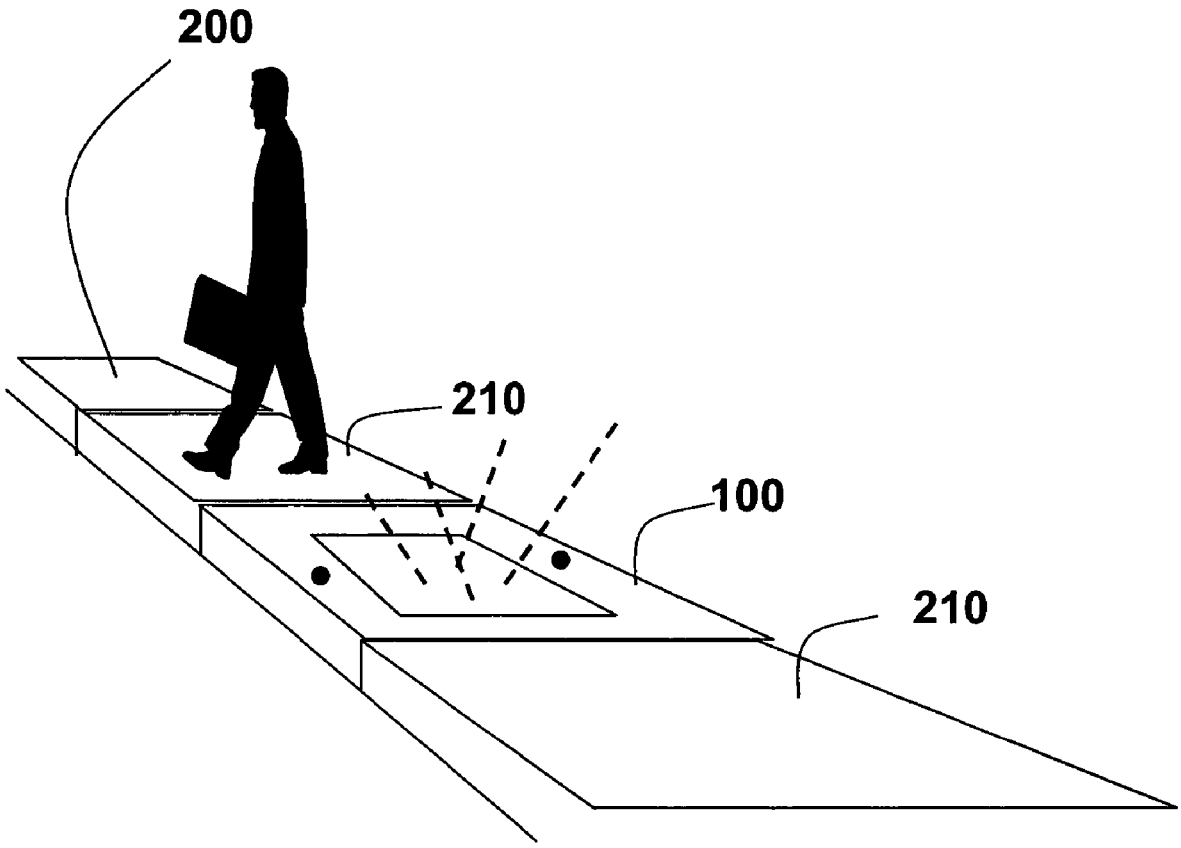
FIG. 1 is a schematic illustration of a paved floor with an illumination device paved as one of the floor's tiles, according to some embodiments of the invention.

Reference will now be made in detail to embodiments of the present invention, examples of which are illustrated in the accompanying drawings, wherein like reference numerals refer to the like elements throughout. The embodiments are described below to explain the present invention by referring to the figures.

An embodiment is an example or implementation of the inventions. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiments, but not necessarily all embodiments, of the inventions. It is understood that the phraseology and terminology employed herein is not to be construed as limiting and are for descriptive purpose only.

The principles and uses of the teachings of the present invention may be better understood with reference to the accompanying description, figures and examples. It is to be understood that the details set forth herein do not construe a limitation to an application of the invention. Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, or integers or groups thereof and that the terms are to be construed as specifying components, features, steps or integers. The phrase "consisting essentially of", and grammatical variants thereof, when used herein is not to be construed as excluding additional components, steps, features, integers or groups thereof but rather that the additional features, integers, steps, components or groups thereof do not materially alter the basic and novel characteristics of the claimed composition, device or method.

If the specification or claims refer to "an additional" element, that does not preclude there being more than one of the additional element. It is to be understood that where the claims or specification refer to "a" or "an" element, such reference is not be construed that there is only one of that element. It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks. The term "method" refers to manners, means, techniques and procedures for accomplishing a given task including, but not limited to, those manners, means, techniques and procedures either known to, or readily developed from known manners, means, techniques and procedures by practitioners of the art to which the invention belongs. The descriptions, examples, methods and materials presented in the claims and the specification are not to be construed as limiting but rather as illustrative only.

Meanings of technical and scientific terms used herein are to be commonly understood as to which the invention belongs, unless otherwise defined. The present invention can be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

The present invention, in some embodiments thereof, provides an illumination device configured to be integrated with a paved floor such as a paved pavement, or any other paved walking surface comprising tiles; and a method for installing the device among the tiles of the paved floor. The illumination devices, according to some embodiments of the invention, provided, may be installed in a paved floor replacing some of the floor's tiles, where the size and shape of each illumination device may be compatible to the size and shape of the floor's tiles.

FIG. 1 schematically illustrates a paved floor 200 comprising one illumination device 100 enabling to emit light therethrough, according to some embodiments of the invention.

The surface area and dimensions of the illumination device 100 may be substantially similar to the dimensions of each tile 210 of the paved floor 200 or to several combined tiles 210, to allow fitting in the array arrangement of the tiles 210.

Figure 2:
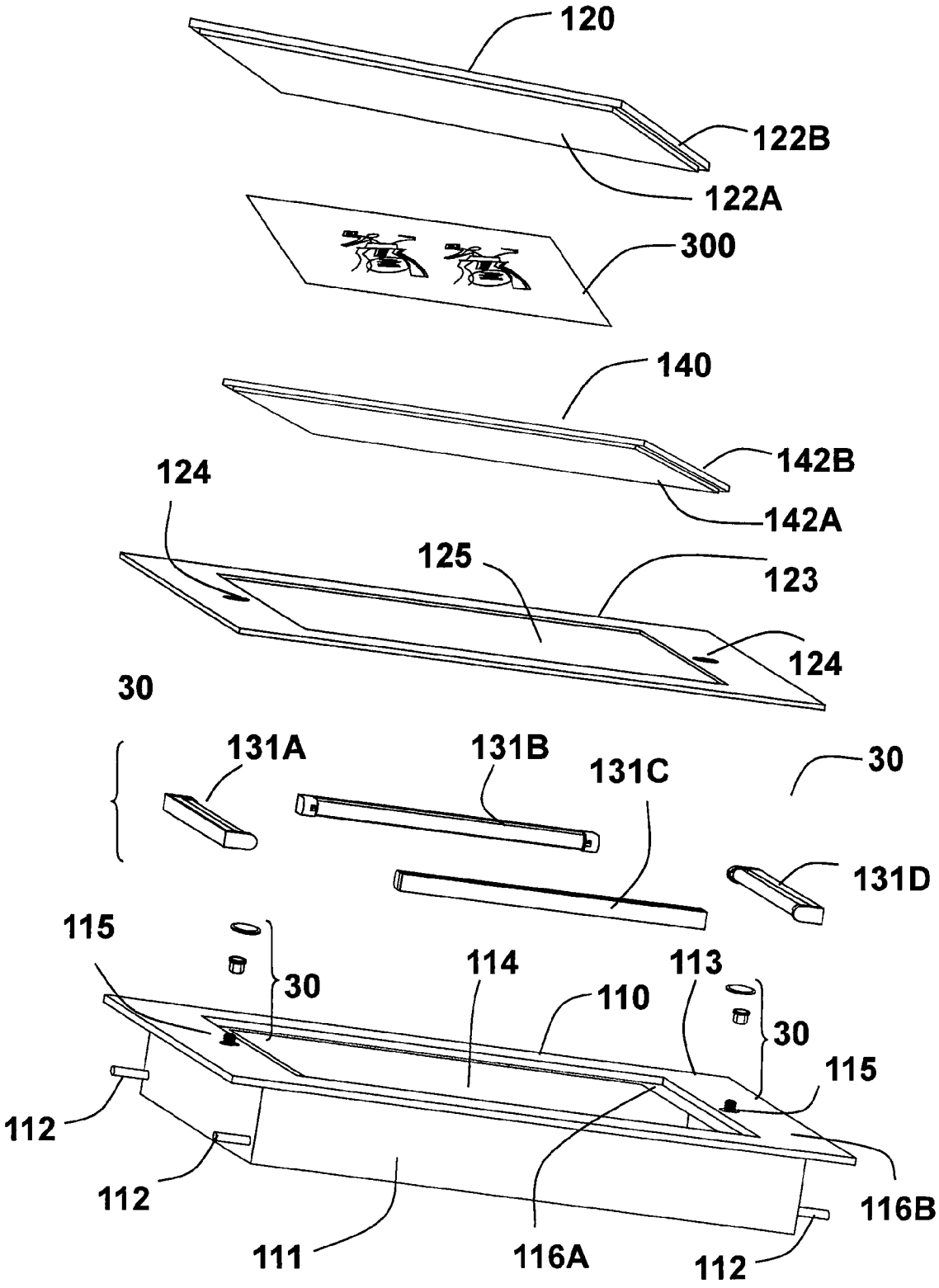
FIG. 2 is an exploded view, schematically illustrating an illumination device, according to some embodiments of the invention.

FIG. 2 schematically illustrates an exploded view of an illumination device 100, according to some embodiments. The illumination device 100 may comprise: a container 110 comprising a box 111, having an open side, where the box 111 walls a cavity created therein and a first frame 113 framing the upper rim of the box 111; an illuminations set 130, enabling to illuminate the illumination device 100; a second frame 123; a cover 120; and at least two fastening means 30.

The illumination set 130 may comprise one or more light sources 131A, 131B, 131C and 131D, where the illumination set 130 may be installed inside the container 110 (e.g. attached to the inner walls of the box 111), where each light source 131A, 131B, 131C and 131D enables illumination of the illumination device 100;

The cover 120, may be transparent or semi-transparent to allow light from the illumination set to be transferred therethrough, and made be made from any material known in the art that is solid and can be made transparent-semi-transparent such as glass or plastic, for instance.

The cover 120 may be seated between the first frame 113 and the second frame 123 and held thereby.

The least two fastening means 30 may enable fastening the second frame 123 to the first frame 113 to hold the cover 120 therebetween.

The cover 120 may be removable, enabling to be removed and reinstalled by any user.

According to embodiments, as illustrated in FIG. 2, the first frame 113 may comprise an inner frame 116A and an outer frame 116B integrally connected to one another. The inner frame 116A may be thinner and smaller in perimeter than the outer frame 116B enabling to hold the cover 120, once the cover 120 is placed upon the inner frame 116A and framed by the outer frame 116B, when installing the illumination device.

Respectively, the cover 120 may include an inner part 122A and an outer part 122B integrally connected to one another, as illustrated in FIG. 2, where the inner part 122A enables covering the inner cavity 114 created by the first frame 113 and where the outer part 122B, which is thinner than the inner part 122A, frames the inner part 122A. The first frame 113 may hold the cover 120 by placing the outer part 122B of the cover 120 upon the inner frame 116A of the first frame 113, allowing the inner frame 16A to hold the outer part 122B.

Once the cover 120 is held by the two frames 113 and 123, the second frame 123, which is removable, may be fastened to the first frame 113 using the fastening means 30.

According to embodiments, the first frame 113 and the second frame 123 may comprise perforated holes 115 and 124 respectively, that allow inserting parts of the fastening means 30 to secure the first frame 113 to the second frame 123, holding the cover 120 therebetween.

According to embodiments, the fastening means 30 may be any means that allow securing the second frame 123 to the first frame 113, such as screws, snaps etc.

According to embodiments, as illustrated in FIG. 2, the first frame 113 and the second frame 123 may comprise perforated holes 115 and 124, respectively, where the holes 115 and 124 allow inserting parts of the fastening means 30 to secure the first frame 113 to the second frame 123, holding the cover 120 therebetween.

According to embodiments, as illustrated in FIG. 2, a sheet 300 comprising content such as graphical and/or advertising content may be attached to the inner side of the cover 120. The sheet 300 may be made from materials and colors that allow light to pass through to a significant extent such as thin paper, transparent/semi-transparent plastic etc. where the content is printed thereupon. The sheet 300 may be placed underneath the cover 120 and also held by the inner frame 116A of the first frame 113, where the sheet 300 may have dimensions that allow it to be held by the inner frame 113.

According to some embodiments, the container 110 may further comprise a plurality of protrusions 112, as illustrated in FIG. 2. The protrusions may be elongated elements protruding from the outer walls of the box 110, where the protrusions 112 may be of the same or of various sizes and lengths and integrally connected to the outer walls of the box 111.

According to embodiments, the light sources 131A, 131B, 131C and 131D may be any light emitting devices known in the art such as, for example, LEDs (Light Emitting Diodes), Halogen or Neon lamps, light bulbs, etc. The light sources 131A, 131B, 131C and 131D may be elongated and may be mounted on the inner walls of the box 111.

The light sources 131A, 131B, 131C and 131D of the illumination set 130 may be provided with electric power according to any technique and power supplying means known in the art such as battery(ies), external power source and the like.

According to embodiments, the illumination sets 130 of all illumination devices 100 of a predefined paved floor 200 or a predefined part of a paved floor 200 may all be wired to a main power supply, where the wiring may be laid out under the floor 200 to hide the wires for esthetic and security purposes.

According to some embodiments, as illustrated in FIG. 2, the illumination device 100 may further comprise a placement 140 that may comprise an inner portion 142A which enables placing the sheet 300 thereupon and an outer portion 142B, integrally connected to the inner portion 142A. The outer portion 142B may be of a larger area than that of the inner portion 142A, enabling the outer portion 142B to be held by the inner frame 116A of the first frame 113.

The placement 140 may be made from a light diffusing material and/or from transparent/semi transparent materials.

According to some embodiments, the cover 120 may be made from light diffusing materials such as Perspex.

According to some embodiments, the cover 120 may be made from light diffusing materials such as Perspex.

According to some embodiments of the invention, the cover 120 may be made from more than one layer where one layer may be transparent and light diffusing such as Perspex.

Figure 3:
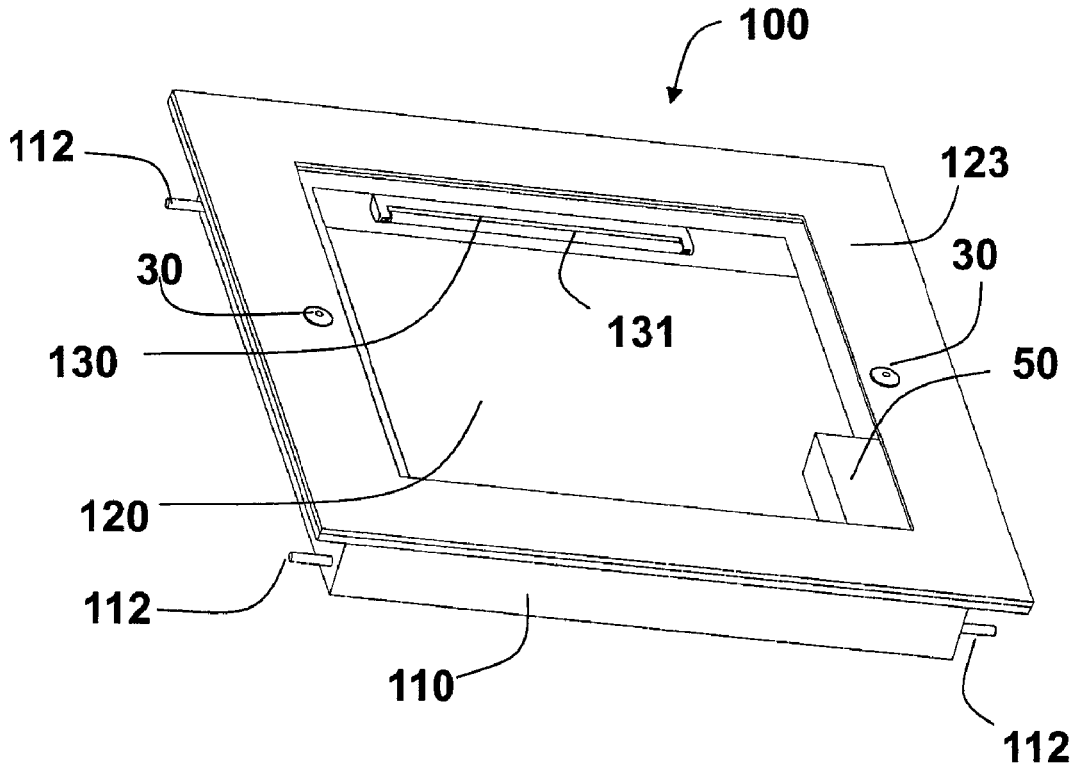
FIG. 3 schematically illustrates an illumination device 100 in an installed position having a battery power source installed in the illumination device, according to some embodiments of the invention.

FIG. 3 schematically illustrates an illumination device 100 in an installed position having a central separate battery power source 50, according to some embodiments of the invention.

Figure 4:
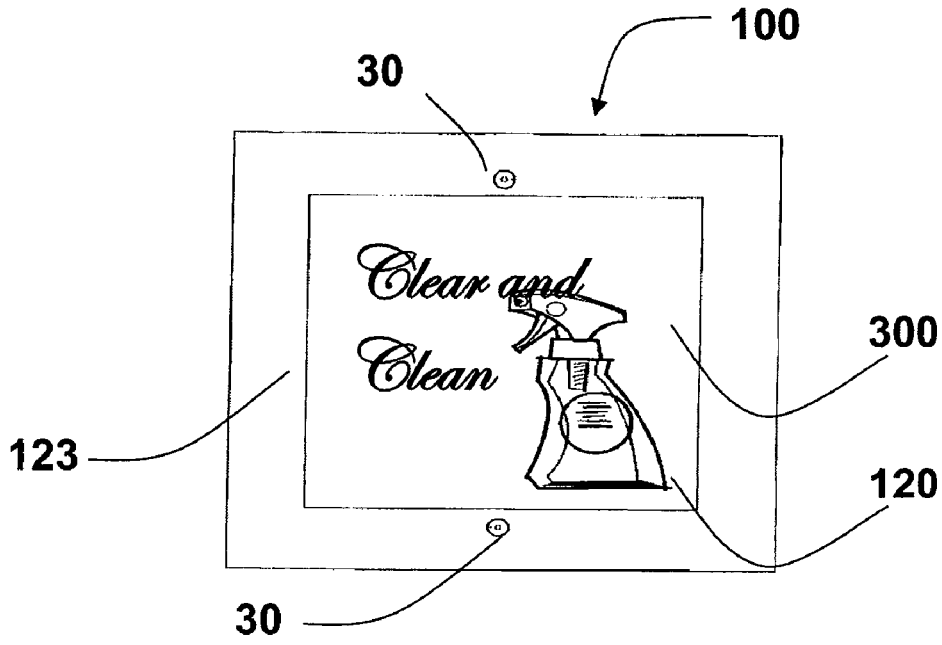
FIG. 4 schematically illustrates the illumination device, illustrated in FIG. 2 in an installed position, according to some embodiments of the invention.

FIG. 4 schematically illustrates an illumination device 100 in an installed position having an advertisement sheet 300 placed underneath the cover 120 of the illumination device 100, according to some embodiments of the invention.

Figure 5:
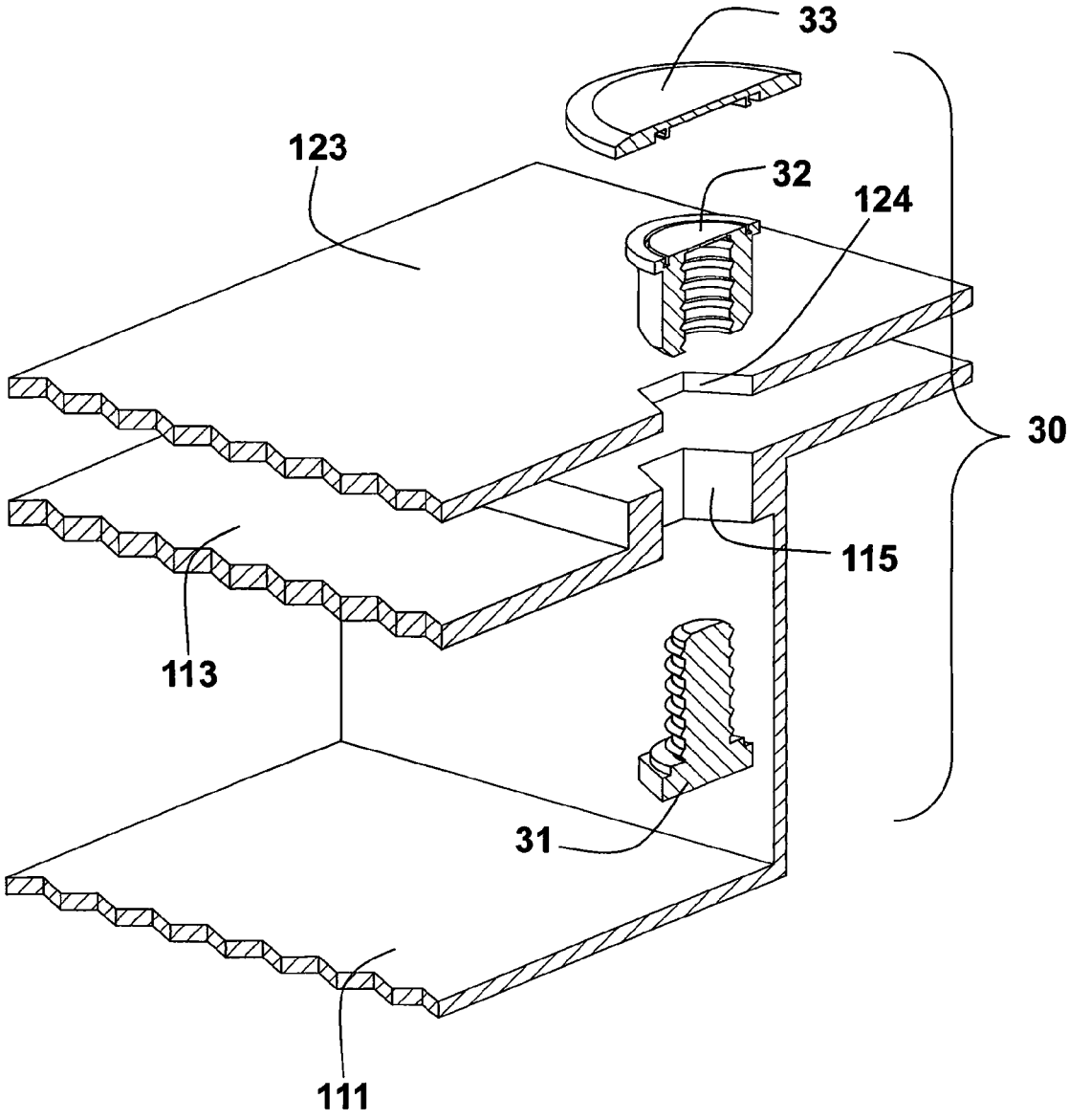
FIG. 5 is a cross sectional exploded view if a part of the illumination device, showing a fastening means that enable fastening some of the illumination device's parts, according to the embodiments illustrated in FIG. 2.

FIG. 5 is a cross sectional exploded isometric view of a part of the illumination device 100, according to some embodiments of the invention. This view shows one fastening means 30, which fastens the first frame 113 to the second frame 123 of the illumination device 100.

According to these embodiments, the fastening means 30 may comprise:

a first member 31, which may be a screw with an externally male thread; a second member 32, which may correspondently be a nut having an internally female screwing engraving adapted to secure to the male screwing engraving of the first member 31; and a covering member 33, enabling to cover the top edge of the second member 32.

The first frame 113 may comprise a niche or an opening 115 perforated therethrough, which receives the first member 31. The second frame may comprise a niche or an opening 124 perforated therethrough, which receives the second member 32.

According to embodiments, as illustrates in FIG. 2 and FIG. 4, the first member 31 may be integrally connected to the first frame 113 e.g. by attaching to the walls of opening 115, where the male screwing engraving may protrude from the first frame allowing the user to assemble the illumination device 100 by placing the placement 140 upon the first frame 113, then placing the sheet 300 upon the placement 140, then placing the cover 120 upon the sheet 300 and then placing the second frame 123 to frame and hold the cover 120, where the male protruding engraving of the first members 31 of all the device's 100 fastening means 30 may be threaded through the openings 123 of the second frame 123. Since the male screwing engraving of the first member 31 of each fastening means 30 is integrally connected to the first frame 113, according to these embodiments, there is no need for the user who assembles the illumination device 100 to hold the first members 31 and therefore, the user is free to place all above-mentioned elements 140, 300, 120 and 123 and then screw each second member 32 having the female inner screwing engraving to each protruding engraving of each first member 31.

According to other embodiments, the first member 31 and the second member 32 may comprise other securing mechanisms (other than screwing based mechanisms) as known in the art.

Figure 6:
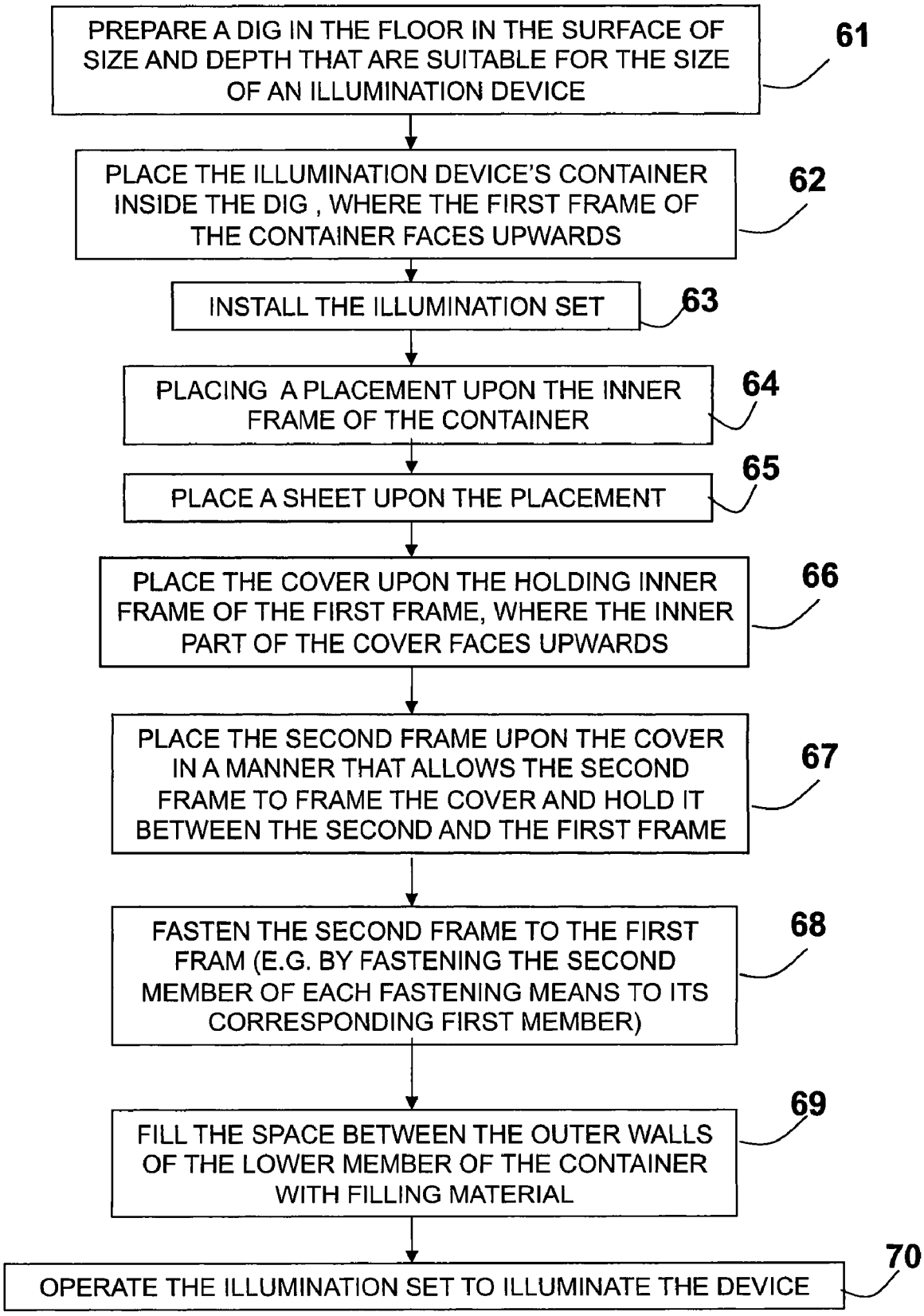
FIG. 6 is a flowchart, schematically illustrating a method for installing an illumination device, according to some embodiments of the invention.

FIG. 6 is a flowchart, schematically illustrating a method for installing the illumination device 100, according to some embodiments of the invention.

The method may comprise: preparing a dig in the floor with a cavity that is suitable in size and depth for receiving the illumination device 100 therein 61; placing the container 110 in the dig 62; installing the illumination set 63; placing the placement 140 upon the inner frame 116A of the first frame 64; placing the sheet 300 upon the placement 65; placing the cover 120 upon the sheet 300 and upon the placement 66; placing the second frame 113 upon the cover 120 in a manner that frames the cover 67; fastening the second frame 123 to the first frame 113 using the fastening means 68; filling the space created between the dig and illumination device 100 with filling materials (e.g. cement) 69; and operating the illumination device 100 to illuminate the paved floor 70.

While the invention has been described with respect to a limited number of embodiments, these should not be construed as limitations on the scope of the invention, but rather as exemplifications of some of the embodiments thereof, including a preferred embodiment. The scope of the invention should not be limited by what has been described, but by the appended claims and their legal equivalents.

What is claimed is:

1. An illumination device comprising:

a container, which comprises a box creating a cavity therein and a first frame, integrally connected to the upper rim of the box, wherein the first frame frames the upper rim of the box;

an illumination set comprising at least one light source, wherein the illumination set is installed inside the container, wherein at least one light source enables illumination of the illumination device;

a cover, which is adapted to be seated within the first frame, wherein the cover enables light from the illumination set to be transferred therethrough;

a second frame, enabling to hold the cover between the first and the second frame; and at least two fastening means enabling to fasten the second frame to the first frame to hold the cover therebetween, wherein the at least one fastening means comprises a first member and a second member adapted to be fastened to one another, wherein the first member is attached to the lower inner side of the first frame and the second member is removable enabling to fasten to the first member and to be removed therefrom, to allow removing and reinstalling the second frame and the cover to the container, and wherein the illumination device is configured to be installed in a paved floor as one of the floor's tiles.

2. The illumination device of claim 1, wherein the container further comprises at least two protrusions, integrally connected to the outer walls of the box of the container and protruding therefrom to facilitate in paving the illumination device in a predefined dig, by placing the container in the dig and then filling a space created between the dig and the box with a filling material poured therein to hold the container in the dig.

3. The illumination device of claim 1, wherein the first frame comprises an inner frame and an outer frame, where the inner frame is thinner than the outer frame enabling to hold the cover, wherein the cover is placed upon the inner frame, which holds it when installing the illumination device, respectively, the cover comprises an inner part and an outer part integrally connected, wherein the inner part enables covering the inner cavity created by the first frame and the outer part, which is thinner than the inner part, frames the inner part, and wherein the cover is held by the first frame by placing the outer part of the cover upon the inner frame of the first frame, allowing the inner frame to hold the outer part.

4. The illumination device of claim 3, further comprising at least one sheet, which comprises printed content, wherein the sheet is inserted between the cover and the first frame.

5. The illumination device of claim 4, further comprising a placement that is placed between the sheet and the first frame to hold the sheet thereupon.

6. The illumination device of claim 5, wherein the placement comprises an inner portion which enables placing the sheet thereupon and an outer portion, integrally connected to the inner portion, wherein the outer portion is of a larger area than that of the inner portion, enabling the outer portion to be held by the inner frame of the first frame.

7. The illumination device of claim 5, wherein the placement is made from a light diffusing material.

8. The illumination device of claim 4, wherein the sheet is made from semi-transparent materials allowing light from the illumination set to pass through.

9. The illumination device of claim 4, wherein the sheet comprises advertising content.

10. The illumination device of claim 1, wherein the cover is made from a transparent material.

11. The illumination device of claim 10, wherein the material from which the cover is made is one of: glass, plastic, and Perspex.

12. The illumination device of claim 1, wherein the cover is made from a multiplicity of layers made from of transparent materials.

13. The illumination device of claim 1, wherein the illumination set comprises four elongated light sources mounted on the inner walls of the container.

14. The illumination device of claim 1, wherein each light source of the illumination set is connected to an inner power source that is installed within the container.

15. The illumination device of claim 1, wherein each light source of the illumination set is connected to an external power source.

16. The illumination device of claim 1, wherein the first member of the fastening means comprises a screw having a male thread integrally attached to the lower inner side of the first frame and the second member of the fastening means comprises a nut having a female inner screw engraving adapted to secure the screw of the first member by screwing thereto.

17. The illumination device of claim 16, wherein the at least one fastening means further comprises a covering member suitable for covering the nut and protruding part of the screw that is secured by the nut.

18. The illumination device of claim 1, wherein the at least one light source of the illumination set comprises a LED.

19. A paved floor comprising a plurality of tiles and at least one illumination device, that illuminates at least one part of the floor surface, each illumination device comprising:

a container, which comprises a box creating a cavity therein and a first frame, integrally connected to the upper rim of the box, wherein the first frame frames the upper rim of the box;

an illumination set comprising at least one light source, wherein the illumination set is installed inside the container, wherein at least one light source enables illumination of the illumination device;

a cover, which is adapted to be seated within the first frame, wherein the cover enables light from the illumination set to be transferred therethrough;

a second frame, enabling to hold the cover between the first and the second frame; and at least two fastening means enabling to fasten the second frame to the first frame to hold the cover therebetween, wherein the at least one fastening means comprises a first member and a second member adapted to be fastened to one another, wherein the first member is attached to the lower inner side of the first frame and the second member is removable enabling to fasten to the first member and to be removed therefrom, to allow removing and reinstalling the second frame and the cover to the container, and wherein the configuration of the illumination device enables installing the illumination device in the paved floor as one of the tiles of the floor.

20. A method of installing an illumination device, comprising:

placing a container in a predefined dig of a floor tile, wherein the container comprises a first frame, a box walling an inner cavity, wherein the first frame is integrally connected to the upper rim of the box, and an illumination set comprising at least one light source, wherein the illumination set is installed inside the container, wherein at least one light source enables illumination of the illumination device;

placing a cover upon the first frame of the container, wherein the cover is adapted to be seated within the first frame, wherein the cover enables light from the illumination set to be transferred therethrough;

placing a second frame upon the first frame, enabling to hold the cover between the first and the second frame;

fastening the second frame to the first frame holding the cover therebetween, using at least two fastening means; and illuminating the floor by turning on the at least light source of the illumination device.

21. The method of claim 20, further comprising filling the space between the outer walls of the box of the container and the dig with filling materials.

22. The method of claim 20, further comprising preparing the dig between surrounding floor tiles with a cavity that is suitable for receiving the illumination device therein.

23. The method of claim 20, further comprising placing a placement upon the first frame and then placing a sheet upon the placement before placing the cover, wherein the sheet is held between the cover and the placement, and wherein the sheet, the placement and the cover enable light to pass through.

* * * * *